US005163878A

United States Patent [19]

Hou et al.

[11] Patent Number: 5,163,878

[45] Date of Patent: Nov. 17, 1992

[54] CAROUSEL ASSEMBLY

[75] Inventors: Jack Hou, Taipei; James Chen, Yun Lin, both of Taiwan

[73] Assignee: Giftec, Ltd., Alexandria, Va.

[21] Appl. No.: 730,614

[22] Filed: Jul. 16, 1991

[51] Int. Cl.[5] ..... A63H 13/10

[52] U.S. Cl. ..... 472/6; 472/12; 446/238

[58] Field of Search ..... 472/6–12; 446/237, 238, 409

[56] References Cited

U.S. PATENT DOCUMENTS

| | | | |
|---|---|---|---|
| 1,271,892 | 7/1918 | Habeshan | 472/6 |
| 1,597,585 | 8/1926 | Ehling | 472/6 |
| 2,061,695 | 11/1936 | Dalton | 472/6 |
| 3,191,930 | 6/1965 | Cottrell et al. | 472/12 X |
| 4,753,436 | 6/1988 | Sinclair | 472/6 |

*Primary Examiner*—Richard E. Chilcot, Jr.
*Attorney, Agent, or Firm*—Bacon & Thomas

[57] ABSTRACT

An ornamental carousel assembly is disclosed which simulates a full-size carousel in that various figurines are supported upon a revolving platform below a canopy. The canopy is formed from a flexible material and is supported on the rotatable platform by a canopy support assembly. The canopy support assembly is composed of a plurality of interconnected ring elements and is attached to the platform by various support rods which are spaced about the periphery of the platform. Since the canopy is made from a flexible material and the canopy support assembly may be disassembled into its individual links, the carousel can be shipped and stored in a relatively small container.

25 Claims, 2 Drawing Sheets

CAROUSEL ASSEMBLY

BACKGROUND OF THE INVENTION

1. Field of the Invention

The present invention pertains to an ornamental carousel assembly. More specifically, the invention relates to an improved ornamental carousel assembly having a canopy support assembly mounted upon a rotatable base platform wherein the support assembly is comprised of a plurality of interengaging ring elements which may be easily disassembled for storage and shipping, and which can be readily joined to form an integral canopy support ring. The invention also incorporates a canopy made from a flexible material which minimizes the space required for storage and shipping.

2. Description of the Prior Art

Ornamental carousel assemblies are known in the prior art which include a canopy mounted on a rotatable base. In these known arrangements, the canopies are formed from a unitary piece generally made from either ceramic or plastic material. Ceramic canopies are inherently fragile and therefore highly susceptible to damage during shipping and assembling. Since ceramic and plastic canopies are formed as unitary structures, the canopies are bulky and require rather large shipping and storage containers. In addition, ceramic and plastic canopies add a considerable amount of weight to the carousel assemblies and therefore provide an additional strain on the rotary driving mechanism.

SUMMARY OF THE INVENTION

It is an object of the present invention to provide an improved ornamental carousel assembly which includes a canopy that is supported on a rotatable base.

It is another object of the present invention to provide a canopy arrangement which is not easily damaged during shipping or storage and which can be housed in a relatively small container as compared to the known prior art assemblies.

These and other objects of the present invention are accomplished by providing an ornamental carousel assembly having a canopy formed from a flexible material (e.g. a fabric) supported on a rotatable base by a canopy support assembly. The flexible canopy is supported by a support assembly formed from a plurality of ring elements which are linked together to form a unitary member. Since the canopy is flexible and the support assembly can be disassembled into individual links, the carousel can be safely shipped and stored in a relatively small container.

Other objects, features and advantages of the invention shall become apparent from the following detailed description of a preferred embodiment thereof, when taken in conjunction with the drawings wherein like reference characters refer to corresponding parts in the several views.

DETAILED DESCRIPTION OF THE PREFERRED EMBODIMENT

Figure 1:
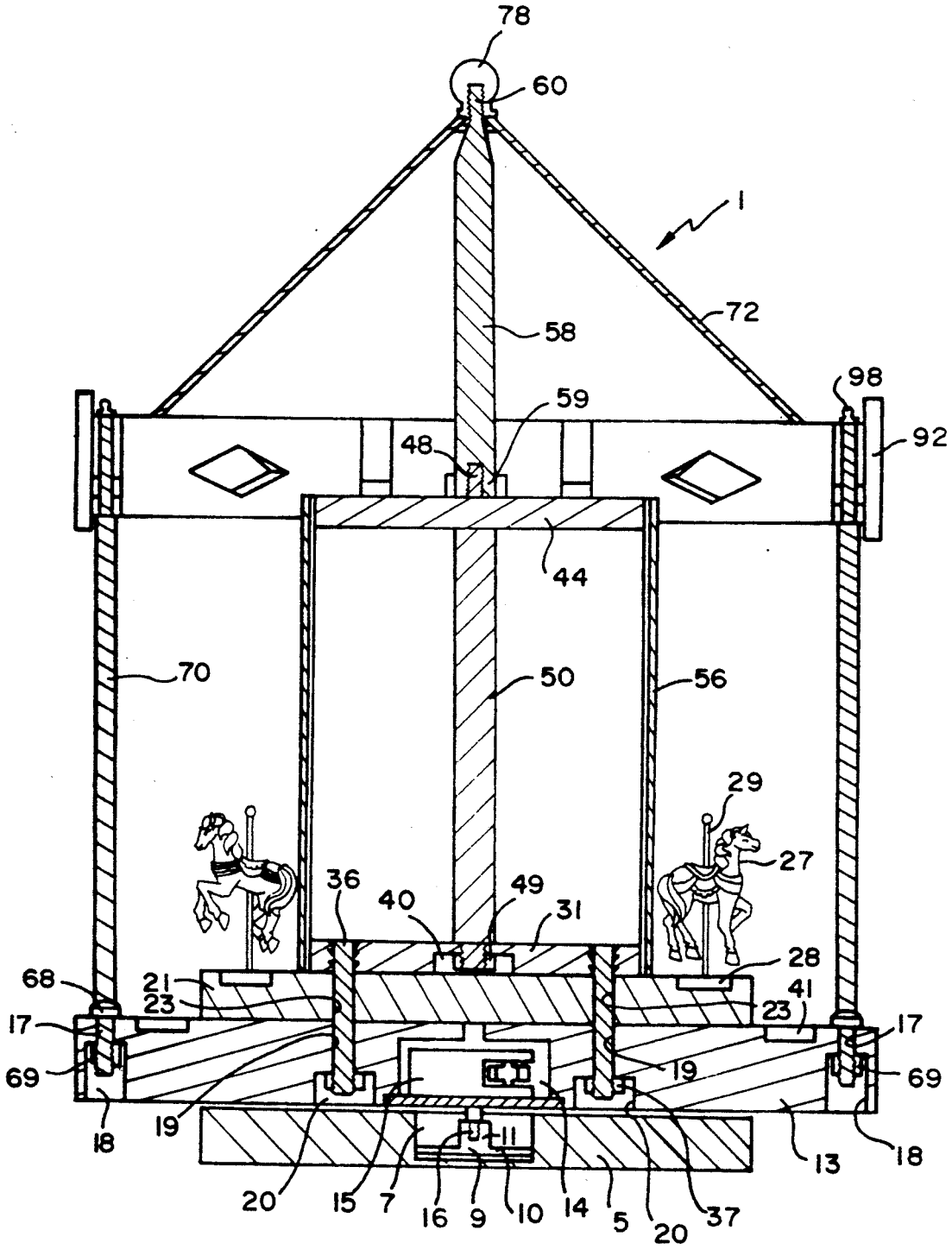
FIG. 1 is a cross-sectional, elevational view of the ornamental carousel assembly according to a preferred embodiment of the invention.
Figure 2:
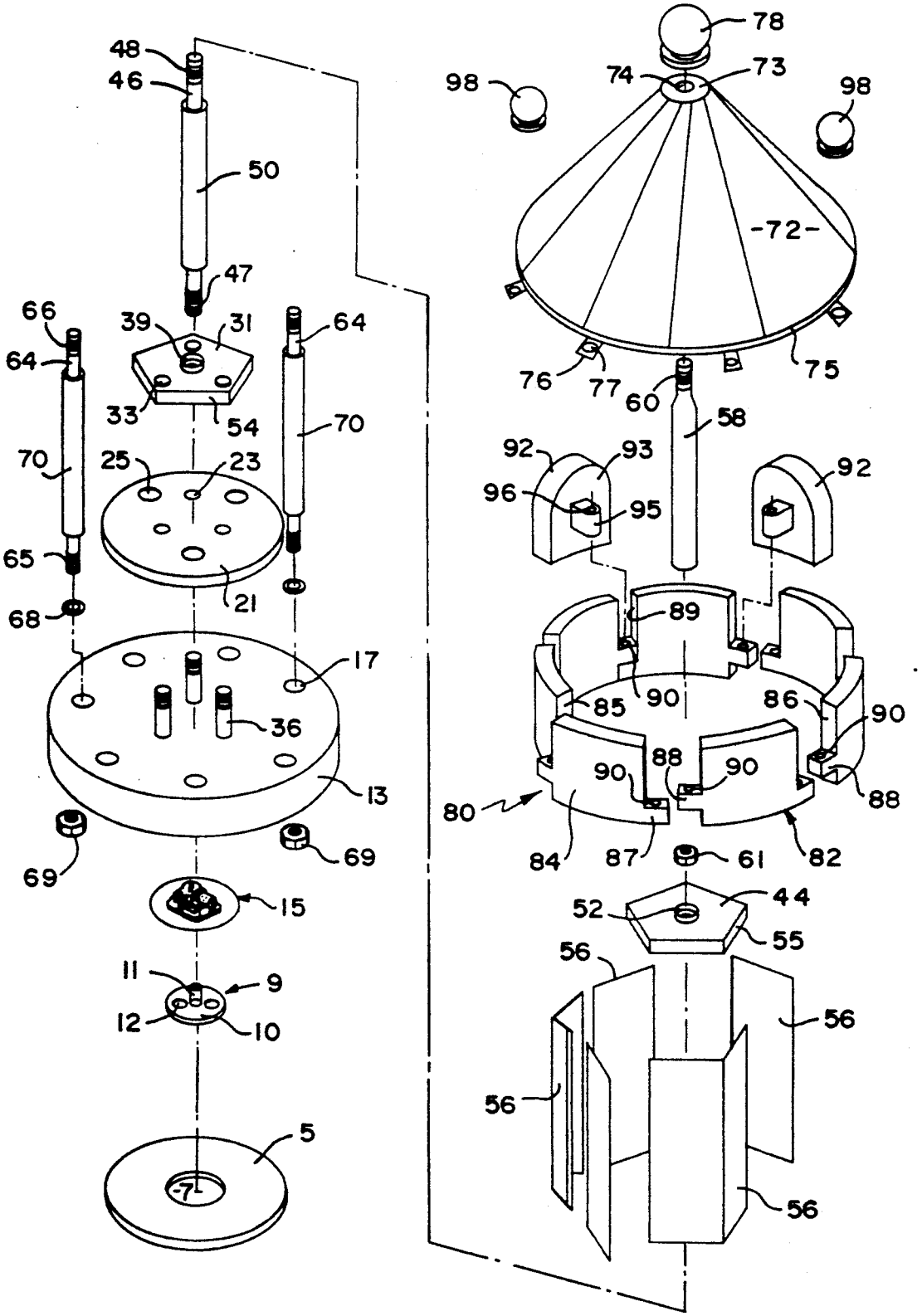
FIG. 2 is an exploded perspective view of the ornamental carousel assembly shown in FIG. 1.

An ornamental carousel assembly 1, according to the preferred embodiment of the invention, shall now be described with reference to FIGS. 1 and 2. As shown therein, carousel assembly 1 includes a stand 5 having a central recessed area 7. Located within recessed area 7 is a mounting plate 9 having a base portion 10 and a central, upwardly extending, internally threaded sleeve 11. Base portion 10 includes a pair of spaced holes 12 for securing mounting plate 9 within recessed area 7 by any attachment means known in the art (not shown) such as screws, bolts, rivets, etc.

Mounted above stand 5 is a base platform 13. Base platform 13 is formed with a plurality of circumferentially spaced outer bores 17 (seven in the preferred embodiment). Located in the bottom of base platform 13 are a plurality of outer concavities 18. Outer concavities 18 are coaxially aligned with outer bores 17 such that each outer bore 17 terminates in a coresponding concavity 18. Located radially inward from outer bores 17 and concavities 18 are a plurality of circumferentially spaced inner bores 19 extending through base platform 13 and terminating in inner concavities 20. In the preferred embodiment, three such inner bore and concavity arrangements are provided.

Located above base platform 13 is a support platform 21 having a plurality of circumferentially spaced apertures 23 which are coaxially aligned with circumferentially spaced inner bores 19 and inner concavities 20 formed in base platform 13. Formed in the top surface of support platform 21, radially outwardly spaced from apertures 23, are a plurality of recesses 25. Recesses 25 are located about the periphery of the top face of support platform 21 and are configured to each receive an ornamental figurine 27 therein. Each ornamental figurine 27 is mounted upon a pedestal 28 by means of an upright rod 29. Each pedestal 28 is press-fit or otherwise secured within a corresponding recess 25.

Base platform 13 is formed with a pocket 14 in the bottom thereof. Mounted in pocket 14 is a miniature music and drive box assembly 15 having a threaded output shaft 16. Output shaft 16 is screwed into internally threaded sleeve 11. By this construction, with output shaft 16 fixed in sleeve 11, drive from the miniature music and drive box assembly 13 causes rotation of the miniature music and drive box assembly 15 itself, along with base platform 13.

Located atop support platform 21 is a lower disc 31. In the preferred embodiment, lower disc 31 is pentagonal in shape and includes a plurality of circumferentially spaced bores 33 coaxially aligned with apertures 23 in support platform 21 and inner bores 19 in base platform 13. Each bore 33 formed in lower disc 31 is tapered to receive the head of a bolt 36 which extends through the associated bore 33 in lower disc 31, aperture 23 in support platform 21 and inner bore 19 of base platform 13. The ends of bolts 36 are externally threaded in order to receive nuts 37. By this construction, tightening of bolts 36 functionally secures together base platform 13, support platform 21 and lower disc 31. As clearly shown in FIG. 1, each nut 37 is located within a corresponding inner concavity 20 formed in the bottom surface of base platform 13. Also formed in lower disc 31 is a central bore 39 terminating in a lower, central concavity 40.

It should be understood that base platform 13, support platform 21 and lower disc 31 may be secured together by various other means widely known in the art. In addition, instead of providing inner concavities 20 in base platform 13, inner bores 19 could simply be arranged to threadably receive a fastener for securing these members together. Furthermore, a plurality of other figurine mounting recesses 41, similar to recesses 25, may also be provided in base platform 13, as shown in FIG. 1, either in addition to or in place of recesses 25.

Vertically spaced from lower disc 31 is an upper disc 44 which is also pentagonal shaped in the preferred embodiment. Upper disc 44 is maintained spaced from lower disc 31 by an elongated space bar 46 having a lower threaded end 47 and an upper threaded end 48. Lower threaded end 47 of space bar 46 extends through central bore 39 of lower disc 31 and is secured therein by a nut 49 located within central concavity 40. Concentrically mounted about elongated space bar 46 is an elongated central sleeve 50. Upper disc 44 rests upon a top end surface of central sleeve 50 with upper threaded end 48 of space bar 46 extending through a central bore 52 formed in upper disc 44.

The side faces 54 of lower disc 31 are vertically aligned with side faces 55 of upper disc 44. Ornamental panels 56 each extend between lower disc 41 and upper disc 44 and are adhesively or otherwise attached to corresponding side faces 54 and 55. In the preferred embodiment, ornamental panels 56 have a glossy or mirror finish so as to function as reflectors.

Located in vertical axial alignment with elongated space bar 46 is an extension rod 58. Extension rod 58 includes a lower, internally threaded end 59 and an upper externally threaded end 60. Internally threaded end 59 is tightened onto upper threaded end 48 of space bar 46, thereby fixing upper disc 44 between elongated sleeve 50 and extension rod 58 and maintaining lower disc 31 and upper disc 44 in the desired, vertically spaced relationship. An additional nut 61 may be interposed between space bar 46 and extension rod 58 for convenience of assembly.

Secured within outer bores 17 formed in base platform 13 are a plurality of support rods 64. Each support rod 64 includes a first, lower threaded end 65 and a second, upper threaded end 66. Lower threaded end 65 of each support rod 64 receives a washer 68, extends through an associated outer bore 17 and is secured to base platform 13 by a nut 69. Each nut 69 is located within a corresponding outer concavity 18 so that both lower threaded end 65 and nut 69 are recessed below the lower surface of base platform 13, as clearly shown in FIG. 1. Each support rod 64 has a concentric support sleeve 70 mounted thereabout.

Ornamental carousel assembly 1 further includes a canopy 72. In the preferred embodiment, canopy 72 is formed from a flexible material such as a fabric, paper etc.. Canopy 72 includes a central support ring 73 having a hole 74 therein. Canopy 72 is conical in shape and extends downwardly and outwardly around extension rod 58, with externally threaded end 60 of extension rod 58 extending through hole 74 of central support ring 73. Canopy 72 extends from central support ring 73 and terminates in a lower circular edge portion 75. Integrally formed with or fixedly secured about the periphery of lower circular edge portion 75 are a plurality of flaps 76. Each flap 76, the number of which corresponds to the number of support rods 64, includes an aperture 77. Central support ring 73 of canopy 72 is secured to threaded end 60 of extension rod 58 by means of an ornamental, ball-shaped nut 78.

Canopy 72 is further supported on carousel assembly 1 by means of flaps 76 on a canopy support assembly 80. Canopy support assembly 80 comprises a plurality of arcuate-shaped ring elements 82 which may be interconnected together to form a continuous ring as will be explained more fully below. Ring elements 82 are substantially identical, with each element 82 including a curvilinear body portion having a front face 84, and side faces 85, 86. Extending outwardly from side face 85 is a first tab 87. A second tab 88 extends outwardly from side face 86. First and second tabs 87, 88 are substantially the same size and are formed coplanar with front face 84 in each ring element 82. Second tab 88 is vertically spaced relative to first tab 87 a distance substantially equal to the height of first tab 87. Each of the first and second tabs 87, 88 include a vertically extending through hole 90. Since second tab 88 is vertically spaced relative to first tab 87 and each ring element 82 is symmetrical, when adjacent ring elements 82 are abutted against each other, second tab 88 overlaps first tab 87 so that the through holes 90 in the first and second tabs 87, 88 are aligned to receive upper threaded end 66 of an associated support rod 64 therethrough. Each of the adjacent ring elements 82 are interconnected in this manner such that a continuous support ring is formed. This support has a larger diameter than the diameter of the lower circular edge portion 75 of canopy 72 so that flaps 76 overlie the support ring.

Since first and second tabs 87, 88 extend outwardly from first and second side faces 85, 86, respectively, a gap 89 is formed between adjacent ring elements 82 above the first and second tabs 87, 88. In order to conceal each gap 89 between adjacent ring elements 82 and to provide additional structural rigidity of canopy support assembly 80, a plurality of shield members 92 are provided. A back surface portion 93 of each shield member 92 has secured thereto or integrally formed therewith a flange 95 having an associated, vertical eyelet 96.

Each flange 95 is receivable in a corresponding gap 89 formed between a pair of adjacent ring elements 82 and the eyelet 96 of each flange 95 is aligned with the through holes 90 formed in first and second tabs 87, 88. The combined vertical height of the respective, aligned first tab 87 on one ring element 82, second tab 88 on an adjacent ring element 82 and corresponding flange 95 is preferably greater than or equal to the verical height of each individual ring element 82. Each flange 95 is secured to back surface portion 93 such that shield member 92 extends both above and below the adjacent interengaging ring elements 82.

Each support rod 64, in addition to extending through the aligned through holes 90 in associated first and second tabs 87, 88 on adjacent ring elements 82, also extends through the eyelet 96 of each flange 95 and the aperture 77 of an associated flap 76 of canopy 72. Ball-shaped nuts 98 are then tightened onto upper threaded end 66 of each support rod 64. Therefore, canopy support assembly 80 rests upon elongated support sleeves 70 and, along with lower edge portion 75 of canopy 72, is secured between support sleeves 70 and nuts 98.

Based on the above description, it can readily be seen that canopy support assembly can be disassembled into its various interengaging ring element and shield members in order to provide for more compact shipping and storage of the ornamental carousel assembly 1. In addition, canopy support assembly 80 permits the use of a flexible canopy 72 and also functions to maintain flexible canopy 72 in an in-use condition.

It is to be understood that various forms of the invention herein shown and described are to be taken as a preferred embodiment thereof and various changes in shape, material, size and arrangement of parts may be resorted to without departing from the spirit of the invention or scope of the following claims.

We claim:

1. A canopy assembly for an ornamental carousel comprising:

a canopy having a lower edge portion;

a plurality of ring elements;

means for interconnecting said plurality of ring elements to form a canopy support; and means for attaching the lower edge portion of said canopy to said canopy support.

2. The canopy assembly of claim 1, wherein each of said ring elements are curvilinear in shape and said canopy is made from a flexible material and is conical in shape.

3. The canopy assembly of claim 1, wherein each of said ring elements includes a front face and a pair of opposed side faces, a first tab projecting substantially perpendicular from one of said side faces and a second tab projecting substantially perpendicular from the other of said side faces.

4. The canopy assembly of claim 3, wherein each of said first and second tabs includes a front surface formed coplanar with said front face.

5. The canopy assembly of claim 3, wherein said ring elements are substantially identical, with said first and second tabs projecting from respective side faces of each ring element being disposed in different horizontal planes such that a second tab on one ring element can overlap a first tab on an adjacent ring element when the ring elements are interconnected.

6. The canopy assembly of claim 5, wherein said first and second tabs on each ring element includes a vertically extending through hole such that when adjacent first and second tabs are overlapped, said through holes are aligned.

7. The canopy assembly of claim 6, wherein said interconnecting means comprises a plurality of fasteners extendible through said aligned through holes.

8. The canopy assembly of claim 7, further comprising a plurality of shield members, each of said shield members having a flange on a back surface thereof, each of said flanges having a vertical eyelet formed therein, and each flange being disposable between a respective pair of adjacent ring elements to align said eyelet with said aligned through holes and receiving a respective one of said fasteners therethrough.

9. The canopy assembly of claim 8, wherein each of said shield members has a height dimension greater than each of said ring elements and a width dimension greater than each of said first or second tabs.

10. The canopy assembly of claim 9, further comprising:

a support ring carried by a central portion of said canopy, said support ring including a central hole therein;

a vertical extension rod having first and second ends; and means for securing said support ring to the first end of said vertical extension rod.

11. The canopy assembly of claim 10, wherein said canopy diverges from said support ring to said lower edge portion, said attaching means including a plurality of circumferentially spaced flap members carried by the lower edge portion of said canopy, each of said flap members having an aperture for receiving a respective one of said fasteners for attaching said canopy to said canopy support.

12. The canopy assembly of claim 11, wherein each of said fasteners comprises a support rod having a threaded end which extends through the aligned through holes in said first and second tabs, the eyelet of a corresponding flange, and the aperture in a corresponding flap member, and said interconnecting means further comprises a plurality of nuts, each nut being threadably engaged on a threaded end of a respective fastener.

13. An ornamental carousel assembly comprising:

a stand;

a base platform;

means for carrying a plurality of ornamental figurines on said base platform;

a canopy having a lower edge portion;

a canopy support including a plurality of interconnected ring elements, the lower edge portion of said canopy being attached to said canopy support assembly;

means for supporting said canopy support assembly above said base platform;

means for rotatably mounting said base platform, said canopy and said canopy support assembly upon said stand; and drive means for rotating said base platform, said canopy and said canopy support assembly relative to said stand.

14. The ornamental carousel assembly of claim 13, wherein said supporting means for said canopy support also interconnects said ring elements.

15. The ornamental carousel assembly of claim 14, wherein said supporting means further includes means for securing the lower edge portion of said canopy to said canopy support.

16. The ornamental carousel of claim 15, wherein said supporting means comprises a plurality of support rods, each of said support rods having a lower end secured to said base platform and an upper end interconnecting adjacent ring elements.

17. The ornamental carousel assembly of claim 16, wherein said supporting means further comprises a plurality of elongated support sleeves, each of said support sleeves being concentrically mounted about a respective one of said support rods with said canopy support engaging said support sleeves.

18. The ornamental carousel assembly of claim 13, further comprising:

a support platform centrally located above said base platform;

a lower disk centrally located above said support platform;

means for securing said base platform, said support platform and said lower disk together;

a plurality of ornamental figurines carried by at least one of said base and support platforms;

an upper disk; and an elongated space bar interconnecting said upper and lower disks.

19. The ornamental carousel assembly of claim 18, further including reflector plate means secured between said upper and lower disks.

20. The ornamental carousel assembly of claim 18, wherein the means for carrying the plurality of ornamental figurines includes a plurality of recesses formed in at least one of said base and support platforms, said plurality of ornamental figurines being disposed within said recesses.

21. The ornamental carousel assembly of claim 20, further comprising:

an extension rod connected to said elongated space bar;

a support ring carried by a central portion of said canopy, said support ring including a central hole therein; and means for fixing said support ring to an upper end of said extension rod.

22. The ornamental carousel assembly of claim 21, wherein said canopy is conical in shape and diverges from said support ring to said lower edge portion, said lower edge portion including a plurality of circumferentially spaced flap members, each flap member having an aperture therein for receiving a respective one of said support rods therethrough.

23. The ornamental carousel assembly of claim 14, wherein a lower central portion of said base platform includes a pocket, said drive means being disposed within said pocket, and said drive means comprises a miniature music box including a rotatable output shaft secured to said stand.

24. The canopy assembly of claim 13, wherein each of said ring elements are curvilinear in shape and said canopy is made from a flexible material.

25. The canopy assembly of claim 14, further comprising a plurality of shield members, each of said shield members having a flange on a back surface thereof, each flange being disposable between a respective pair of adjacent ring elements, and each of said shield members being secured to a respective pair of adjacent ring elements by said supporting means.

* * * * *